US010317822B2

(12) United States Patent
Suzuki et al.

(10) Patent No.: US 10,317,822 B2
(45) Date of Patent: Jun. 11, 2019

(54) IMAGE FORMING APPARATUS AND IMAGE FORMING METHOD

(71) Applicant: Brother Kogyo Kabushiki Kaisha, Nagoya-shi, Aichi-ken (JP)

(72) Inventors: Takashi Suzuki, Nagoya (JP); Tsunemitsu Fukami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/104,389

(22) Filed: Aug. 17, 2018

(65) Prior Publication Data

US 2019/0056683 A1 Feb. 21, 2019

(30) Foreign Application Priority Data

Aug. 17, 2017 (JP) ..... 2017-157478

(51) Int. Cl.
*G03G 15/16* (2006.01)

(52) U.S. Cl.
CPC ..... *G03G 15/1665* (2013.01)

(58) Field of Classification Search
CPC ..... G03G 15/0266; G03G 15/1665; G03G 15/1675; G03G 15/50; G03G 15/5088; G03G 21/168
USPC ..... 399/38, 43, 46, 66, 297
See application file for complete search history.

(56) References Cited

U.S. PATENT DOCUMENTS 6,512,905 B1 * 1/2003 Tomiki ..... G03G 15/0216 399/11
8,428,493 B2 * 4/2013 Mase ..... G03G 15/234 399/167
8,693,919 B2 4/2014 Shiraki
2011/0176832 A1 7/2011 Mase
2011/0236071 A1 9/2011 Shiraki

FOREIGN PATENT DOCUMENTS

JP 2011-150140 A 8/2011
JP 2011-203361 A 10/2011
JP 2015-068924 A 4/2015

* cited by examiner

*Primary Examiner* — Hoan H Tran
(74) *Attorney, Agent, or Firm* — Banner & Witcoff, Ltd.

(57) ABSTRACT

An image forming apparatus has a photosensitive member, a charger, a developing device, a transfer device, and a controller. In a printing control, the controller rotates the photosensitive member in a forward direction and applies a first transfer bias. In a reverse rotation control, the controller rotates the photosensitive member in a reverse direction and applies a second transfer bias being zero after finishing the printing control. In a forward rotation control, the controller rotates the photosensitive member in the forward direction and applies a third transfer bias for a period including a time that a part of the photosensitive member reaches the transfer device after finishing the reverse rotation control. The part faces the developing device when the rotating direction of the photosensitive member is switched. The third transfer bias has an opposite polarity to the first transfer bias and an absolute value larger than the second transfer bias.

14 Claims, 5 Drawing Sheets

DURING PRINTING

10

BIAS SWITCHING (Vt1→Vt2)

MOTOR STOP

REVERSE ROTATION

MOTOR STOP

FORWARD ROTATION SWITCHING/
BIAS SWITCHING (Vt2→Vt3)

FORWARD ROTATION

BIAS SWITCHING (Vt3→Vt1)

EXPOSURE START

IMAGE FORMING APPARATUS AND IMAGE FORMING METHOD

CROSS-REFERENCE TO RELATED APPLICATION

This application claims priority from Japanese Patent Application No. 2017-157478 filed on Aug. 17, 2017, the entire subject-matter of which is incorporated herein by reference.

TECHNICAL FIELD

The present disclosure relates to an image forming apparatus including a photosensitive member capable of rotating in forward and reverse directions, and an image forming method of the image forming apparatus.

BACKGROUND

In the related art, an image forming apparatus has been known which is configured to rotate a photosensitive member in a reverse direction on re-conveyance of conveying a sheet with being inverted during a duplex printing. Specifically, according to this technology, when forming an image on the sheet, the photosensitive member is rotated in a forward direction and a transfer bias of a first polarity is applied to a transfer device. After forming an image on a first surface of the sheet, when a conveying direction of the sheet is switched, the photosensitive member is rotated in a reverse direction.

During a time period in which the photosensitive member is rotated in the reverse direction, the transfer bias is set to OFF or a bias of a second polarity in opposite to the first polarity so that developer is not to move from the photosensitive member to the transfer device. After switching the photosensitive member from the reverse rotation to the forward rotation, the transfer bias is set to the bias of the first polarity.

However, when switching the rotation direction of the photosensitive member from the reverse direction to the forward direction, the developer may be attached to a part, which faces a developing roller, of the photosensitive member.

SUMMARY

The specification discloses an image forming technology that enables to suppress developer from moving from a photosensitive member to a transfer device in a case where a rotation direction of the photosensitive member is switched from a reverse direction to a forward direction.

One illustrative aspect provides an image forming apparatus having:

a photosensitive member;

a charger configured to charge the photosensitive member;

a developing device configured to develop an electrostatic latent image on the photosensitive member;

a transfer device configured to transfer a developer image on the photosensitive member to a sheet; and a controller configured to execute:

a printing control, in which the controller rotates the photosensitive member in a forward direction and applies a first transfer bias to the transfer device;

a reverse rotation control, in which the controller rotates the photosensitive member in a reverse direction and applies a second transfer bias to the transfer device after finishing the printing control, the second transfer bias being zero or having an opposite polarity to the first transfer bias and an absolute value smaller than the first transfer bias; and a forward rotation control, in which the controller rotates the photosensitive member in the forward direction and applies a third transfer bias to the transfer device for a predetermined period of time including a time that a part of the photosensitive member reaches the transfer device after finishing the reverse rotation control, the part facing the developing device at a time of switching the rotating direction of the photosensitive member, and the third transfer bias having an opposite polarity to the first transfer bias and an absolute value larger than the second transfer bias.

The aspect provides an image forming method of an image forming apparatus that includes:

a photosensitive member;

a charger configured to charge the photosensitive member;

a developing device configured to develop an electrostatic latent image on the photosensitive member; and a transfer device configured to transfer a developer image on the photosensitive member to a sheet, the method having:

a printing step of rotating the photosensitive member in a forward direction and applying a first transfer bias to the transfer device;

a reverse rotation step of rotating the photosensitive member in a reverse direction and applying a second transfer bias to the transfer device after finishing the printing step, the second transfer bias being zero or having an opposite polarity to the first transfer bias and an absolute value smaller than the first transfer bias; and a forward rotation step of rotating the photosensitive member in the forward direction and applying a third transfer bias to the transfer device for a predetermined period of time including a time that a part of the photosensitive member reaches the transfer device after finishing the reverse rotation step, the part facing the developing device at a time of switching the rotating direction of the photosensitive member, and the third transfer bias having an opposite polarity to the first transfer bias and an absolute value larger than the second transfer bias.

According to the above configuration, although the developer in the developing device may be attached to the photosensitive member in a case where the rotating direction of the photosensitive member is switched from the reverse direction to the forward direction, it is possible to suppress the developer attached to the photosensitive member from moving to the transfer device because the third transfer bias, which has an opposite polarity to the first transfer bias and the absolute value larger than the second transfer bias, is applied to the transfer device while the developer passes the transfer device.

It is therefore possible to suppress a surface potential of the photosensitive member from excessively increasing during the reverse rotation of the photosensitive member, and to suppress the developer attached to the photosensitive member from moving to the transfer device in a case where the rotation direction of the photosensitive member is switched from the reverse direction to the forward direction.

DETAILED DESCRIPTION

Figure 1:
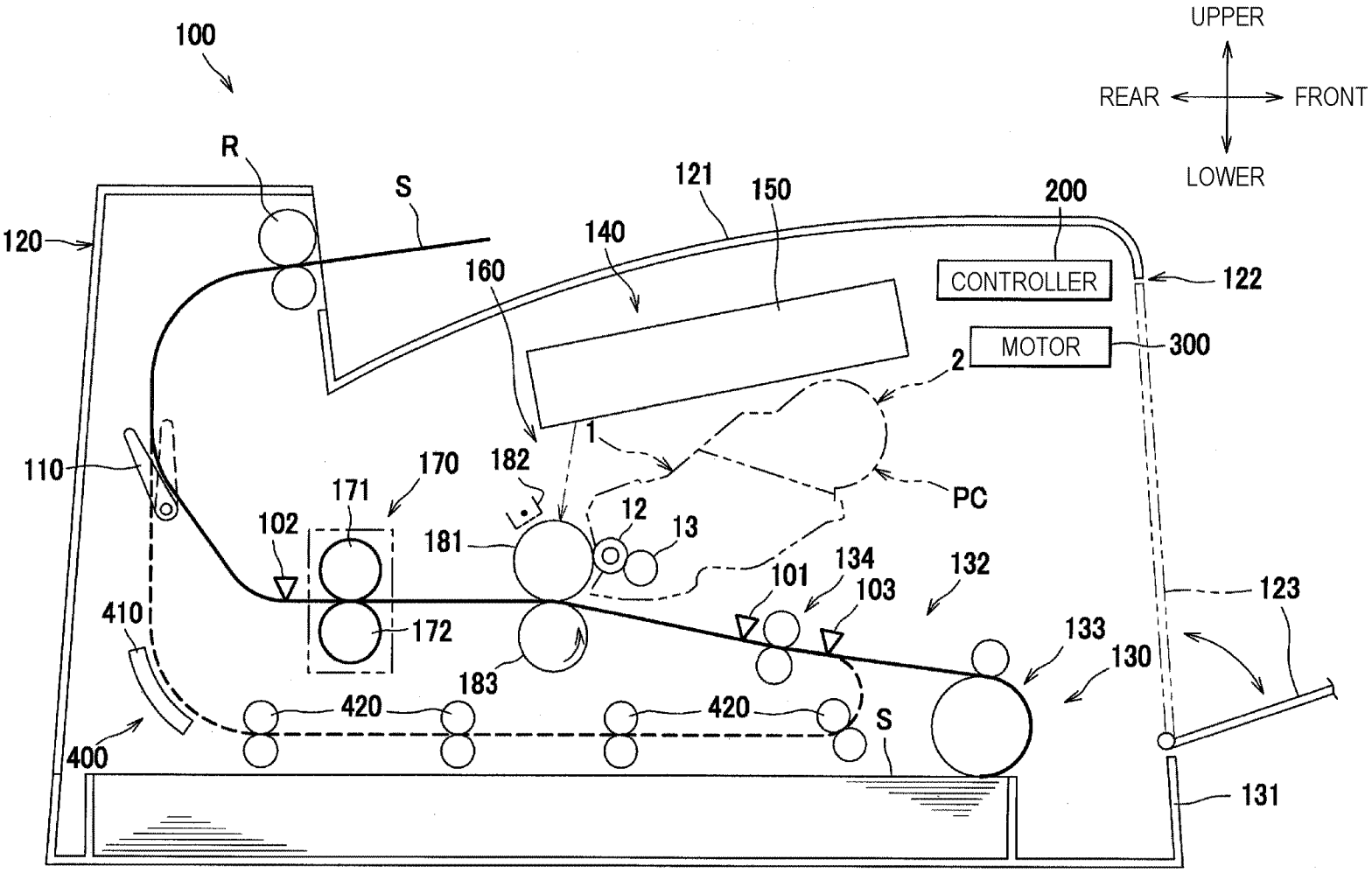
FIG. 1 depicts a schematic configuration of a laser printer in accordance with an illustrative embodiment of the present disclosure.
Figure 2:
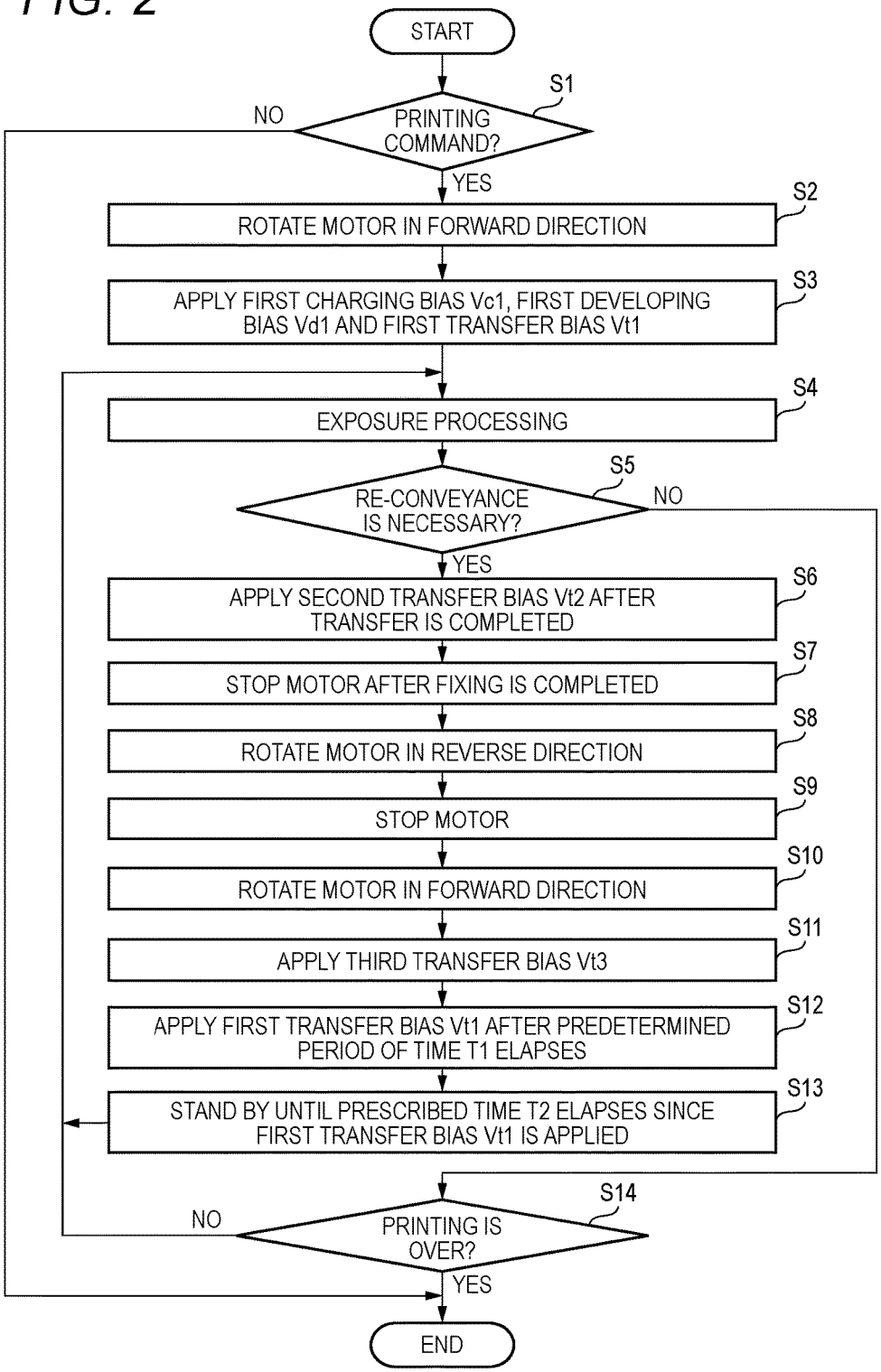
FIG. 2 is a flowchart depicting operations of a controller.

Hereinafter, an illustrative embodiment of the present disclosure will be described in detail with reference to the drawings.

In below descriptions, the directions are described on the basis of directions shown in FIG. 1. That is, in FIG. 1, a right side of the drawing sheet is referred to as 'front side', a left side of the drawing sheet is referred to as 'rear side', an inner side of the drawing sheet is referred to as 'right side' and a front side of the drawing sheet is referred to as 'left side'. Also, the upper and lower direction of the drawing sheet is referred to as 'vertical direction'.

As shown in FIG. 1, a laser printer 100 includes a feeder unit 130, an image forming unit 140, a controller 200, a motor 300, and a re-conveyance mechanism 400, in a main body housing 1.20. A drive force of the motor 300 is transmitted to the feeder unit 130 and the image forming unit 140.

The feeder unit 130 includes a supply tray 131 detachably mounted to a lower part of the main body housing 120, and a conveyance mechanism 132 configured to convey a sheet S in the supply tray 131 toward the image forming unit 140. The conveyance mechanism 132 includes a supply mechanism 133 configured to convey the sheet S in the supply tray 131 toward registration rollers 134 and the registration rollers 134 for aligning evenly each position of a leading end of the sheet S being conveyed. A first sheet sensor 101 is provided downstream of the registration rollers 134 with respect to a conveying direction of the sheet S. The first sheet sensor 101 is a sensor configured to detect the sheet S that is to be conveyed from the registration rollers 134 toward a transfer device 183. The first sheet sensor 101 is arranged at a position closer to the registration rollers 134 than the transfer device 183.

The first sheet sensor 101 includes a swing lever configured to swing as it is pushed by the sheet S being conveyed, and an optical sensor configured to detect the swinging of the swing lever. In the illustrative embodiment, while the sheet S is passing, i.e., when the swing lever is toppled by the sheet S, the first sheet sensor 101 becomes ON.

A third sheet sensor 103 is provided upstream of the registration rollers 134 with respect to the conveying direction of the sheet S. The third sheet sensor 103 is a sensor configured to detect the sheet S that is to be conveyed from the supply mechanism 133 or the re-conveyance mechanism 400 toward the registration rollers 134. The third sheet sensor 103 has a configuration similar to the first sheet sensor 101. The registration rollers 134 are configured so that the registration rollers are to contact the conveyed sheet S with rotation thereof being stopped and to start rotation after predetermined time since the sheet S is detected by the third sheet sensor 103, thereby aligning evenly the leading end of the sheet S.

The image forming unit 140 has a function of forming an image on the sheet S. The image forming unit 140 includes an exposure device 150, a process unit 160, and a fixing device 170.

The exposure device 150 is provided at an upper part in the main body housing 120, and includes a laser light emitting unit, a polygon mirror, a lens, a reflector and the like, which are not shown. The exposure device 150 is configured to irradiate a laser beam to a surface of a photosensitive member 181 (which will be described later) by high-speed scanning.

The process unit 160 includes a photosensitive member 181, a charger 182, a transfer device 183, and a process cartridge PC. In the process cartridge PC, developer is accommodated. The photosensitive member 181 is a circular cylinder-shaped photosensitive drum. The photosensitive member 181 is configured to rotate in forward and reverse directions. Here, the forward direction indicates a rotating direction on image formation, and the reverse direction indicates a direction opposite to the forward direction.

The charger 182 includes a charging wire and a grid electrode, and is configured to charge the photosensitive member 181 by corona discharge. The transfer device 183 is a circular column-shaped transfer roller, and is in contact with the photosensitive member 181. The transfer device 183 is coupled to a rotary shaft of the photosensitive member 181 by a gear. Thereby, the transfer device rotates so that a contact part with the photosensitive member 181 is to move in the same direction.

The process cartridge PC is detachably mounted to the main body housing 120 through an opening 122 that is to he opened and closed by a front cover 123 rotatably provided to a front wall of the main body housing 120. The process cartridge PC includes a developing device 1 and a developer cartridge 2.

The developing device 1 includes a developing roller 12 configured to supply the developer with being in contact with the photosensitive member 181 and a supply roller 13 configured to supply the developer to the developing roller 12. The developer cartridge 2 is detachably mounted to the developing device 1. The developer cartridge 2 has the developer accommodated therein, and includes a mechanism for delivering the developer to the developing device 1.

In the process unit 160, a surface of the photosensitive member 181 being rotated is uniformly charged by the charger 182 and is then exposed by the high-speed scanning of the laser beam from the exposure device 150. Thereby, an electrostatic latent image based on image data is formed on the surface of the photosensitive member 181.

Subsequently, the developer in the process cartridge PC is supplied to the electrostatic latent image on the photosensitive member 181, so that a developer image is formed on the surface of the photosensitive member 181. That is, the electrostatic latent image on the photosensitive member 181 is developed by the developing device 1, so that the developer image is formed on the surface of the photosensitive member 181. Then, the sheet S is conveyed between the photosensitive member 181 and the transfer device 183, so that the developer image on the photosensitive member 181 is transferred to the sheet S.

The fixing device 170 includes a heating roller 171 and a pressing roller 172 to be pressed to the heating roller 171. In the fixing device 170, the developer image transferred to the sheet S is heat-fixed while the sheet S passes between the heating roller 171 and the pressing roller 172. A second sheet sensor 102 configured to detect passing of the sheet S discharged from the fixing device 170 is provided downstream of the fixing device 170 with respect to the conveying direction of the sheet S. The second sheet sensor 102 has a configuration similar to the first sheet sensor 101.

Rollers R capable of rotating in the forward direction and the reverse direction are provided downstream of the fixing device 170. The rollers R are configured to rotate in the forward direction to thereby convey the sheet S in one direction and to rotate in the reverse direction to thereby convey the sheet S in the other direction. Here, one direction is a direction facing from the rollers R toward the discharge tray 121, and the other direction is a direction facing from the discharge tray 121 toward the rollers R. The sheet S heat-fixed in the fixing device 170 is conveyed to the rollers R arranged downstream of the fixing device 170 and is sent toward the discharge tray 121 by the rollers R being rotated in the forward direction.

Here, during a duplex printing in which images are formed on both surfaces of the sheet S, before the sheet S is entirely discharged onto the discharge tray 121, the rollers R are rotated in the reverse direction, so that the sheet S is pulled back into the main body housing 120. The sheet S pulled back into the main body housing 120 passes a rear side of the fixing device 170 by a switching of a flapper 110 and is then sent to the re-conveyance mechanism 400.

The re-conveyance mechanism 400 is a mechanism configured to invert a front surface and a back surface of the sheet S having the first surface on which the developer image is heat-fixed in the fixing device 170, thereby re-conveying the sheet to an upstream side of the registration rollers 134. The re-conveyance mechanism 400 is arranged between the image forming unit 140 and the supply tray 131. The re-conveyance mechanism 400 includes a guide member 410, and a plurality of return rollers 420.

The guide member 410 is a guide for switching a direction of the sheet 5, which passes the rear side of the fixing device 170 and is being conveyed downward, to a front direction. The return rollers 420 are rollers configured to return the sheet S guided by the guide member 410 to the upstream side of the registration rollers 134.

The return rollers 420 are configured to rotate in the forward direction by the drive force of the motor 300, irrespective of the rotating direction of the motor 300. That is, the plurality of return rollers 420 is configured to rotate in a direction in which the sheet S is sent toward the registration rollers 134, on both rotations of the forward rotation and the reverse rotation of the motor 300.

The sheet S conveyed by the re-conveyance mechanism 400 is sent to the registration rollers 134 with the front and back surfaces being inverted. Thereby, after the leading end of the sheet S is aligned evenly by the registration rollers 134, the sheet is again conveyed between the photosensitive member 181 and the transfer device 183, so that the developer image on the surface of the photosensitive member 181 is transferred to a second surface of the sheet S.

The motor 300 is a motor configured to drive the photosensitive member 181, the rollers R and the like, and is coupled to the photosensitive member 181, the rollers R and the like. In a case where the motor 300 is rotated in the forward direction, the photosensitive member 181 and the rollers R are rotated in the forward direction. In a case where the motor 300 is rotated in the reverse direction, the photosensitive member 181 and the rollers R are rotated in the reverse direction.

Also, the motor 300 is coupled to the developing roller 12 via a one-way clutch. The one-way clutch is configured to transmit the drive force in a case where the motor 300 is rotated in the forward direction so that the developing roller 12 rotates, and not to transmit the drive force in a case where the motor 300 is rotated in the reverse direction so that the developing roller 12 does not rotate.

The controller 200 includes a CPU, a RAM, a ROM, a non-volatile memory, an ASIC, an input/output circuit, and the like. The controller 200 is configured to execute a variety of calculation processing on the basis of a printing command output from an external computer, signals output from the respective sheet sensors 101 to 103, and programs and data stored in the ROM and the like, thereby controlling biases applied to the transfer device 183, the rotation of the motor 300 and the like. A value of voltage applied to the transfer device 183 is referred to as "bias." Meanwhile, in the below, only the control relating to the present disclosure will be described, and the descriptions of the other controls, for example, the controls of the feeder unit 130 and the fixing device 170 will be omitted.

The controller 200 is configured to execute a printing control of rotating the photosensitive member 181 in the forward direction and forming an image on the sheet S, and a reverse rotation control of rotating the photosensitive member 181 in the reverse direction. Also, the controller 200 is configured to execute a forward rotation control of rotating the photosensitive member 181 in the forward direction.

In a case of executing a printing control of developing the electrostatic latent image on the photosensitive member 181 and transferring the same to the sheet S, the controller 200 rotates the motor 300 in the forward direction to rotate the photosensitive member 181 in the forward direction, and applies a first transfer bias Vt1 to the transfer device 183. Also, in the case of executing the printing control, the controller 200 applies a first charging bias Vc1 to the charger 182, applies a first developing bias Vd1 to the developing roller 12, and rotates the developing roller 12 in the forward direction. In the case of executing the printing control, the developing roller 12 rotates in a direction opposite to the photosensitive member 181. In other words, in the case of executing the printing control, the surfaces of the photosensitive member 181 and the developing roller 12 move in the same direction at contact parts and a peripheral speed of the developing roller 12 is higher.

Here, the first transfer bias Vt1 may be set to −1.8 kV to −3.5 kV, for example. Also, the first charging bias Vc1, specifically, the bias to be applied to the grid electrode may be set to +610V, and the first developing bias Vd1 may be set to a bias having an absolute value smaller than the first charging bias Vc1, for example, to +270V. In the meantime, in a case where the first transfer bias Vt1, the first charging bias Vc1 and the first developing bias Vd1 are set to the above values, a surface potential of the photosensitive member 181 immediately after the charging is about +600V, and the surface potential of the photosensitive member 181 immediately after passing the transfer device 183 is about +100V.

In a case where the controller 200 executes the reverse rotation control after finishing the printing control, the controller 200 rotates the motor 300 in the reverse direction to rotate the photosensitive member 181 in the reverse direction, and applies a second transfer bias Vt2 to the transfer device 183. The second transfer bias Vt2 is a bias that has an opposite polarity to the first transfer bias Vt1 and an absolute value smaller than the first transfer bias Vt1. The second transfer bias Vt2 may be set to a bias having an absolute value larger than the first charging bias Vc1, for example, to +850V. Here, the second transfer bias Vt2 has the same polarity as the surface potential of the photosensitive member 181 and the absolute value equal to or larger than the surface potential, so that it is possible to suppress current from flowing from the surface of the photosensitive member 181 toward the transfer device 183.

In a case where the controller 200 executes the next printing control after finishing the reverse rotation control, the controller 200 executes the forward rotation control before executing the next printing control. In the forward rotation control, the controller rotates the motor 300 in the forward direction to rotate the photosensitive member 181 in the forward direction, and applies a third transfer bias Vt3 to the transfer device 183 for a predetermined period of time T1 including a time that a part Pd (refer to FIG. 5A), which faces the developing roller 12 at the time of switching the rotating direction, of the photosensitive member 181 reaches the transfer device 183. The predetermined period of time T1 is set to a time period within a length of time that the photosensitive member 181 rotates one turn.

The third transfer bias Vt3 is a bias that has an opposite polarity to the first transfer bias Vt1 and an absolute value larger than the second transfer bias Vt2. The third transfer bias Vt3 may be set to a bias having an absolute value smaller than the first transfer bias Vt1, for example, to +1.6 kV.

When the predetermined period of time T1 elapses after the controller 200 switches the rotating direction of the photosensitive member 181 from the reverse direction to the forward direction, the controller switches a transfer bias, which is to be applied to the transfer device 183, from the third transfer bias Vt3 to the first transfer bias Vt1. The controller 200 starts the exposure by the exposure device 150 after a part Pt (refer to FIG. 5C), which faces the transfer device 183 at the time of switching the transfer bias, of the photosensitive member 181 passes a position LP (refer to FIG. 5F) facing the exposure device 150.

In a case of switching the conveying direction of the sheet S, the controller 200 changes the rotating direction of the motor 300. Here, in a case where the motor 300 is rotated in the reverse direction to rotate the photosensitive member 181 in the reverse direction, the drive force of the motor 300 is not transmitted to the developing roller 12 by the one-way clutch.

Subsequently, operations of the controller 200 are described in detail.

As shown in FIG, 2, the controller 200 determines whether a printing command is received (S1). In a case where a printing command is not received (No) in step S1, the controller 200 ends the control.

In a case where a printing command is received (Yes) in step S1, the controller 200 rotates the motor 300 in the forward direction (S2). Thereby, the developing roller 12 is rotated in the forward direction together with the photosensitive member 181. After step S2, the controller 200 applies the first charging bias Vc1 to the charger 182, applies the first developing bias Vd1 to the developing roller 12, and applies the first transfer bias Vt1 to the transfer device 183 (S3). Thereby, in a case of transferring the developer to the first surface of the sheet S, the motor 300 is rotated in the forward direction and the transfer bias is set to the first transfer bias Vt1 (for example, time t1 in FIG. 3).

After step S3, the controller 200 executes exposure processing of exposing the photosensitive member 181 by the exposure device 150 (S4). Specifically, after a predetermined time since the first sheet sensor 101 becomes ON, the controller 200 executes the exposure processing corresponding to an image of one page, and forms an electrostatic latent image corresponding to an image of one page on the photosensitive member 181.

After step S4, the controller 200 determines whether it is necessary to re-convey the sheet S by determining whether image data for which the exposure processing is to be executed next time is data corresponding to the second surface of the sheet S (S5). In a case where it is determined that it is necessary to re-convey the sheet S (Yes) in step S5, the controller 200 applies the second transfer bias Vt2 to the transfer device 183 after the transfer of the developer image to the first surface of the sheet S is completed (56). That is, after the transfer of the developer image to the first surface of the sheet S is completed, the transfer bias is switched from the first transfer bias Vt1 to the second transfer bias Vt2 (time t2 in FIG. 3). In the meantime, the controller may determine whether the transfer of the developer image to the first surface of the sheet S is completed, based on elapse time after the first sheet sensor 101 becomes ON, for example.

Figure 3:
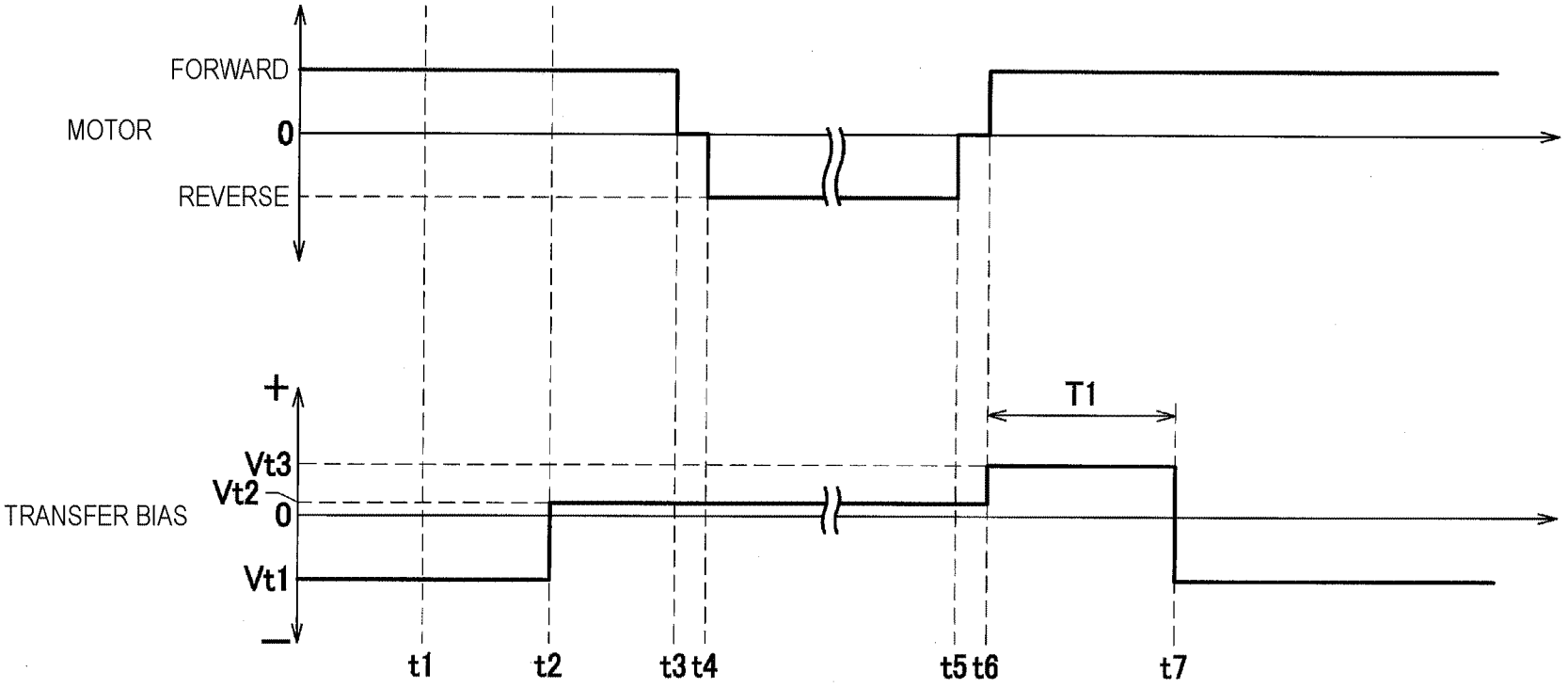
FIG. 3 is a timing chart depicting controls of a motor and a transfer bias.

After step S6, the controller 200 stops the motor 300 after the developer image on the sheet S is fixed by the fixing device 170, specifically, when a part adjacent to a rear end portion of the sheet S is supported by the rollers R (S7, time t3 in FIG. 3). In the meantime, the stop timing of the motor 300 may be set on the basis of elapse time after the second sheet sensor 102 becomes OFF, for example.

After step S7, the controller 200 rotates the motor 300 in the reverse direction (S8, time t4 in FIG. 3). During the reverse rotation of the motor 300, the photosensitive member 181 is rotated in the reverse direction and the drive force is not transmitted to the developing roller 12. Also, in step S6, while the transfer bias is switched from the first transfer bias Vt1 to the second transfer bias Vt2 and the photosensitive member 181 is thus rotated in the reverse direction, the second transfer bias Vt2 is applied to the transfer device 183.

After step S8, the controller 200 stops the motor 300 after the rear end of the sheet S escapes from the rollers R and before the leading end of the sheet S reaches the registration rollers 134 (S9, time t5 in FIG. 3). In the meantime, the stop timing of the motor 300 may be set, as described above. After step 59, the controller 200 rotates the motor 300 in the forward direction (S10, time to in FIG. 3). Thereby, the developing roller 12 is rotated in the forward direction together with the photosensitive member 181.

After step 510, specifically, at substantially the same timing as step S10, the controller 200 applies the third transfer bias Vt3 to the transfer device 183 (S11, time to in FIG. 3). After step S11, the controller 200 applies the first transfer bias Vt1 to the transfer device 183 after the predetermined period of time T1 elapses since the applying of the third transfer bias Vt3 starts (S12, time t7 in FIG. 3).

After step S12, the controller 200 causes the sheet S to stand by at the position of the registration rollers 134 for a prescribed time T2 (S13). After step S13, the controller 200 returns to step S4 and executes the exposure processing.

Here, the prescribed time T2 may be set on the basis of a following equation (1).

$$T2 \geq TA-(TB+TC) \quad (1)$$

TA: time necessary for the part Pt, which faces the transfer device 183 at a time of switching the transfer bias from the third transfer bias Vt3 to the first transfer bias Vt1, of the photosensitive member 181 to reach the position LP (the position to be exposed by the exposure device 150) facing the exposure device 150

TB: time after the first sheet sensor 101 becomes ON until the exposure processing starts TC: time necessary for the leading end of the sheet S to move from a position at the time of switching the transfer bias from the third transfer bias Vt3 to the first transfer bias Vt1 it to the position of the first sheet sensor 101 (movement distance/conveying speed of the sheet S)

In a case where it is not possible to lengthen a distance of a re-conveyance path (refer to the broken line in FIG. 1) due to miniaturization of the laser printer 100, the first sheet sensor 101 becomes ON and a part (a part of a surface potential E2 in FIG. 5F) at which the surface potential is increased is exposed before the part Pt, which faces the transfer device 183 at the time of switching the transfer bias from the third transfer bias Vt3 to the first transfer bias Vt1, of the photosensitive member 181 reaches the position LP facing the exposure device 150. In this case, the developer image becomes faint. However, in the illustrative embodiment, since the sheet S is caused to stand by at the position of the registration rollers 134 during the prescribed time T2, it is possible to expose a part (a part of a surface potential E1 in FIG. 5F) of the proper surface potential. In the meantime, in a case where the distance of the re-conveyance path is sufficiently long, the standby time at the registration rollers 134 may be set to a normal time (a time enough to align evenly the leading end of the sheet S). That is, in the illustrative embodiment, before performing the printing on the second surface of the sheet S, the sheet S is caused to stand by at the position of the registration rollers 134 during the prescribed time T2 longer than the normal standby time. However, in a case where the distance of the re-conveyance path is sufficiently long, it is not necessary to cause the sheet S to stand by for a time period longer than the normal standby time.

In the meantime, the motor 300 is coupled to the registration rollers 134 via a clutch (not shown). The controller 200 turns on/off the clutch, thereby rotating/stopping the registration rollers 134.

In a case where it is determined that the re-conveyance is not necessary (No) in step 55, the controller 200 determines whether the printing is over, specifically, whether the printing of the number of pages designated in the printing command is all completed (S14). In a case where it is determined that the printing is not over (No) in step S14, the controller 200 returns to the processing of step S4. In a case where it is determined that the printing is over (Yes) in step S14, the controller 200 ends the control.

Subsequently, an example of the operation of the controller 200 is described in detail.

Figure 4A:
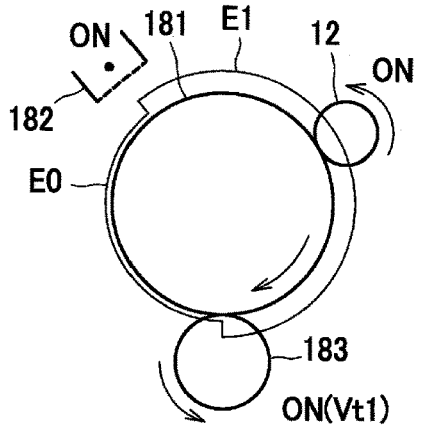
FIGS. 4A to 4E depict a change in a surface potential of a photosensitive member, and the like after a first surface of a sheet is printed until the motor is rotated in a reverse direction and is stopped.

In a case of transferring the developer image to the first surface of the sheet S (for example, time t1 in FIG. 3), the controller 200 rotates the motor 300 in the forward direction to rotate the photosensitive member 181 in the forward direction and sets the transfer bias to the first transfer bias Vt1, which is a minus value. In this situation, the surface potential of the photosensitive member 181 is as shown in FIG. 4A. Specifically, in a case of forming an image on the first surface of the sheet S, a part, which is located downstream of the charger 182 with respect to the rotating direction of the photosensitive member 181 and upstream of the transfer device 183 with respect to the rotating direction, of the photosensitive member 181 has a surface potential E1 that is suitable for the exposure. Also, a part, which is located downstream of the transfer device 183 with respect to the rotating direction and upstream of the charger 182 with respect to the rotating direction, of the photosensitive member 181 has a surface potential E0 close to zero (0) due to an influence of the first transfer bias Vt1. That is, the surface potential E1 of the part charged by the charger 182 is reduced to the surface potential E0 due to the influence of the first transfer bias Vt1.

Figure 4B:
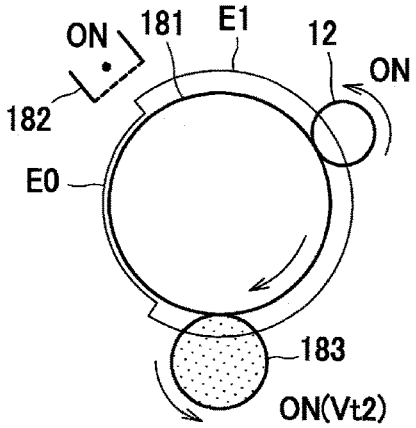

After the transfer of the developer image to the first surface of the sheet S is completed, the controller 200 switches the transfer bias from the first transfer bias Vt1 to the second transfer bias Vt2 (time t2 in FIG. 3). Thereby, as shown in FIG. 4B, the part of the photosensitive member 181 charged by the charger 182 is little influenced by the second transfer bias Vt2, which is a plus small value, and passes the transfer device 183 with keeping the surface potential E1.

Figure 4C:
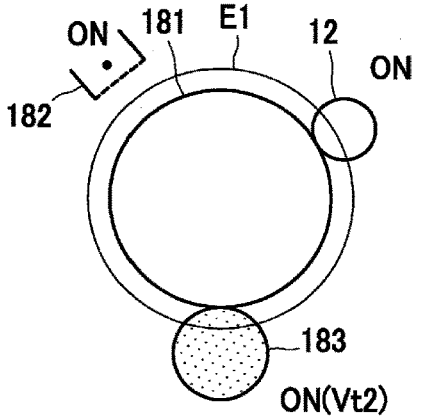

Thereafter, at a predetermined timing before the sheet S having the first surface on which the developer image has been transferred passes through the fixing device 170 and is completely discharged to the discharge tray 121 by the rollers R, the controller 200 stops the motor 300 (time t3 in FIG. 3), as shown in FIG. 4C. At this time, since the photosensitive member 181 has rotated one turn or more from the state of FIG. 4B, the entire surface of the photosensitive member 181 has the surface potential E1. Here, the photosensitive member 181 rotates one turn or more, so that the part of the surface potential E1 passes the charger 182. However, the surface potential is kept at E1 without being influenced by the charger 182.

Figure 4D:
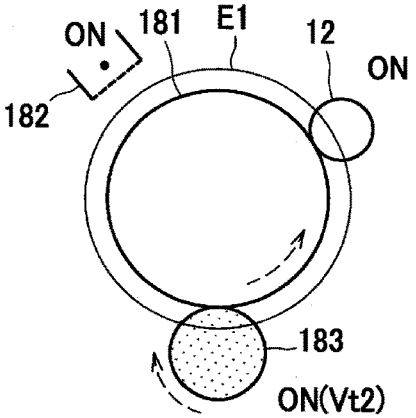

Thereafter, as shown in FIG. 4D, the controller 200 rotates the motor 300 in the reverse direction (time t4 in FIG. 3) to rotate the photosensitive member 181 in the reverse direction. At this time, the drive force of the motor 300 is not transmitted to the developing roller 12 by the one-way clutch. The developing roller 12 is in a stationary state or in a state in which it rotates slightly in the reverse direction by a frictional force from the photosensitive member 181. At this time, the surfaces of the photosensitive member 181 and the developing roller 12 move in the same direction at the contact parts and a peripheral speed of the photosensitive member 181 is set higher.

Figure 4E:
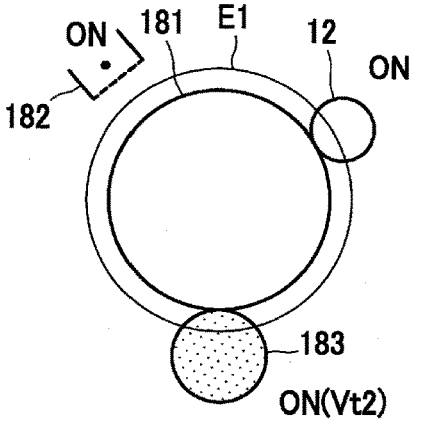

Thereafter, as shown in FIG. 4E, the controller 200 stops the motor 300 (time t5 in FIG. 3) before the leading end of the sheet S reaches the registration rollers 134, thereby stopping the photosensitive member 181. Then, as shown in FIG. 5A, the controller 200 rotates the motor 300 in the forward direction to rotate the photosensitive member 181 in the forward direction and switches the transfer bias from the second transfer bias Vt2 to the third transfer bias Vt3 (time t6 in FIG. 3).

In a case of switching the photosensitive member 181 from the reverse rotation to the forward rotation, the developer on the developing roller 12 is likely to be attached to the part Pd, which faces the developing roller 12, of the photosensitive member 181. When the developer is attached to the part Pd, which faces the developing roller 12, of the photosensitive member 181, the part Pd having the developer attached thereto moves toward the transfer device 183 in association with the forward rotation of the photosensitive member 181, as shown in FIG. 5B.

Figure 5A:
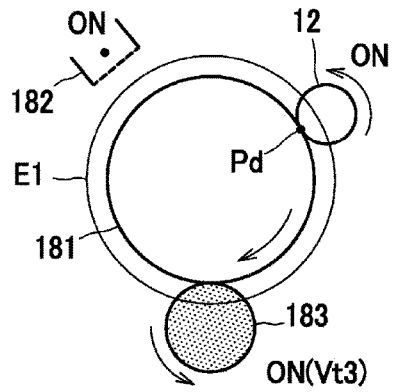
FIGS. 5A to 5F depict the change in the surface potential of the photosensitive member, and the like after the motor is switched to a forward rotation until exposure starts.
Figure 5B:
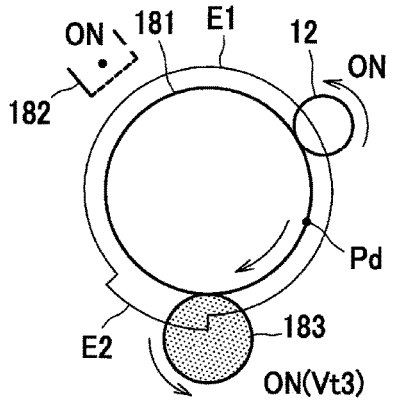

Also, since the third transfer bias Vt3 is a plus large value, after the photosensitive member 181 is rotated in the forward direction from the state of FIG. 5A to the state of FIG. 5B, the part, which has passed the transfer device 183, of the photosensitive member 181 has a surface potential E2 larger than the surface potential E1 due to the influence of the third transfer bias Vt3.

Figure 5C:
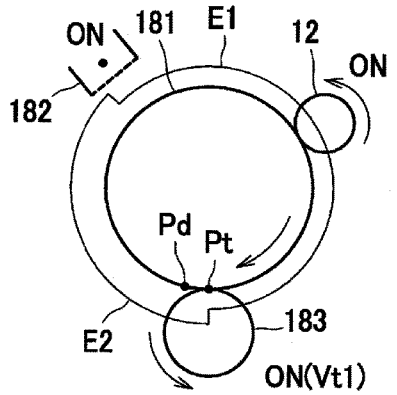

After applying the third transfer bias Vt3 for the predetermined period of time T1, the controller 200 switches the transfer bias from the third transfer bias Vt3 to the first transfer bias Vt1 (time t7 in FIG. 3), as shown in FIG. 5C. At this time, the part Pd having the developer attached thereto has already passed the position facing the transfer device 183. That is, when the part Pd having the developer attached thereto faces the transfer device 183, since the third transfer bias Vt3, which is a plus large value, is applied to the transfer device 183, it is possible to favorably suppress the developer from moving from the part Pd toward the transfer device 183.

Figure 5D:
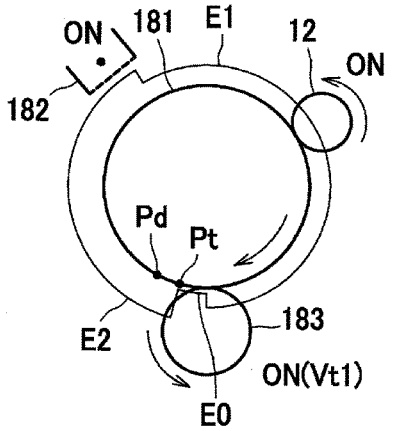

After the photosensitive member 181 is rotated in the forward direction from the state of FIG. 5C to the state of FIG. 5D, the surface potential of the part, which has passed the transfer device 183, of the photosensitive member 181 is reduced from the surface potential E1 to the surface potential E0 due to the influence of the first transfer bias Vt1, which is a minus large value. Also, at this time, a part, which has the largest surface potential E2, of the photosensitive member 181 passes the charger 182 but the part having the large surface potential E2 keeps the surface potential E2 without being influenced by the charger 182.

Figure 5E:
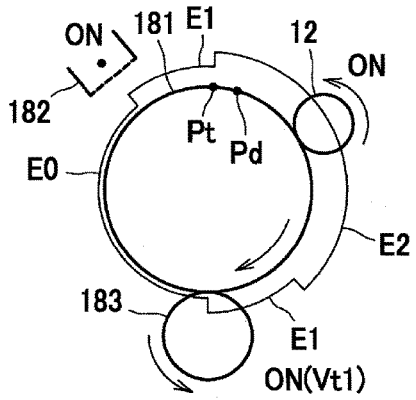

As shown in FIG. 5E, after the photosensitive member 181 is further rotated in the forward direction and the part of the surface potential E0 passes the charger 182, the part of the surface potential E0 is charged and has the surface potential E1. That is, although the surface of the photosensitive member 181 is influenced by the charger 182 in a case where the surface potential is small, the surface of the photosensitive member 181 is little influenced by the charger 182 in a case where the surface potential increases to some extent.

Figure 5F:
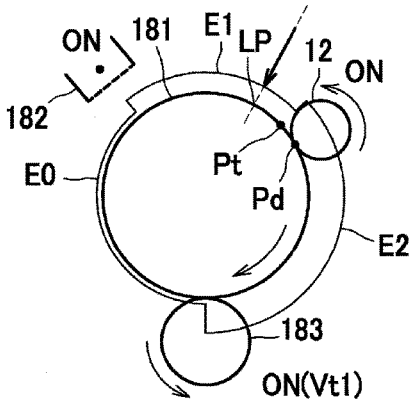

As shown in FIG. 5F, after the part, which has the largest surface potential E2, of the photosensitive member 181 passes the position LP that is exposed by the exposure device 150, the controller 200 starts the exposure processing. Meanwhile, in the illustrative embodiment, since the part Pd having the developer attached thereto has reached the position facing the developing roller 12 on the start of the exposure processing, the developer on the part Pd is collected by the developing roller 12. The timing at which the exposure processing starts and the timing at which the developer on the part Pd is collected by the developing roller 12 may not substantially the same timings, unlike the illustrative embodiment, and may be different timings.

According to the above illustrative embodiment, it is possible to accomplish following effects.

The laser printer 100 may include the photosensitive member 181, the charger 182, the developing device 1, the transfer device 183 and the controller 200. In the case of executing the printing control, the controller 200 rotates the photosensitive member 181 in the forward direction and applies the first transfer bias Vt1 to the transfer device 183. In the case of executing the reverse rotation control, the controller 200 rotates the photosensitive member 181 in the reverse direction and applies the second transfer bias Vt2 to the transfer device 183. Also, in a case where the rotating, direction of the photosensitive member 181 is switched from the reverse direction to the forward direction, the third transfer bias Vt3, which has an opposite polarity to the first transfer bias Vt1 and an absolute value lager than the second transfer bias Vt2, may he applied to the transfer device 183 for the predetermined period of time including the time that the part, which faces the developing device 1 at the time of switching the rotating direction, of the photosensitive member 181 reaches the transfer device 183. According to this configuration, in a case where the rotating direction of the photosensitive member 181 is switched from the reverse direction to the forward direction, it is possible to suppress the developer from moving to the transfer device 183. Also, in a case of rotating the photosensitive member 181 in the reverse direction, since the small second transfer bias Vt2, which has an opposite polarity to the first transfer bias Vt1, is applied to the transfer device 183, it is possible to suppress the surface potential of the photosensitive member 181 from excessively increasing.

The predetermined period of time T1 in which the third transfer bias Vt3 is to he applied can he set to a short time period within a length of time that the photosensitive member 181 rotates one turn. According to this configuration, it is possible to suppress the surface potential of the photosensitive member 181 from excessively increasing by the third transfer bias Vt3.

The laser printer 100 may include the exposure device 150, and the controller 200 may start the exposure after the part, which faces the transfer device 183 at the time of switching the transfer bias from the third transfer bias Vt3 to the first transfer bias Vt1, of the photosensitive member 181 passes the position facing the exposure device 150. According to this configuration, since it is possible to suppress the part, which has the surface potential increased by the third transfer bias Vt3, of the photosensitive member 181 from being exposed, it is possible to suppress the developer image from being faint.

In the meantime, the present disclosure is not limited to the illustrative embodiment, and can be diversely used, as exemplified below.

In the above illustrative embodiment, the rotating speed of the photosensitive member 181 is constant. However, the present disclosure is not limited thereto. For example, in a case of performing the printing with a predetermined first image quality, the rotating speed of the photosensitive member 181 may be set to a first rotating speed, and in a case of performing the printing with a second image quality higher than the first image quality, the rotating speed of the photosensitive member 181 may be set to a second rotating speed higher than the first rotating speed.

Also, in this case, the controller 200 may be configured to increase an absolute value of the current flowing through the transfer device 183 as the rotating speed of the photosensitive member 181 becomes higher, for the predetermined period of time T1. Specifically, for example, in the processing of step S11, it is determined whether the rotating speed of the photosensitive member 181 is higher than the first rotating speed. In a case where it is determined that the rotating speed of the photosensitive member 181 is equal to or lower than the first rotating speed, the controller 200 applies the third transfer bias Vt3 to the transfer device 183 such that the absolute value of the current flowing through the transfer device 183 is a predetermined value. Also, in a case where the rotating speed of the photosensitive member 181 is higher than the first rotating, speed, the controller 200 increases a value of the third transfer bias Vt3 such that the absolute value of the current flowing through the transfer device 183 is higher than the predetermined value. According to this configuration, it is possible to suppress a situation where a charge amount per unit time to be applied to the photosensitive member 181 from the transfer device 183 becomes largely different in correspondence to the rotating speed of the photosensitive member 181.

Also, in a case of rotating the photosensitive member 181 in the forward direction, the controller 200 may rotate the photosensitive member 181 at a first peripheral speed, and in a case of rotating the photosensitive member 181 in the reverse direction, the controller 200 may rotate the photosensitive member at a second peripheral speed equal to or lower than the first peripheral speed. Specifically, for example, the controller 200 may control the rotating speed of the motor 300 so that the peripheral speed of the photosensitive member 181 is to be the first peripheral speed, in steps S2 and S10, and so that the peripheral speed of the photosensitive member 181 is to be the second peripheral speed, in step S8.

In the above illustrative embodiment, the second transfer bias Vt2 is set to the value slightly larger than zero (0). However, the present disclosure is not limited thereto. For example, the second transfer bias may be zero (0).

In the above illustrative embodiment, the charging bias and the developing bias are constant, irrespective of the rotating direction of the photosensitive member 181. However, the present disclosure is not limited thereto. For example, the charging bias and the developing bias may be set to different values on the forward rotation and on the reverse rotation. For example, the charging bias on the forward rotation may he set to the first charging bias Vc1, and the charging bias on the reverse rotation may be set to the second charging bias Vc2 smaller than the first charging bias Vc1. The second charging bias Vc2 may be set to +550V, for example. Also, for example, the developing bias on the forward rotation may he set to the first developing bias Vd1, and the developing bias on the reverse rotation may be set to the second developing bias Vd2 smaller than the first developing bias Vd1.

In the above illustrative embodiment, the photosensitive drum has been exemplified as the photosensitive member 181. However, the present disclosure is not limited thereto. For example, a belt-shaped photosensitive member may also be used.

In the above illustrative embodiment, the drive force is not transmitted to the developing roller 12 by the one-way clutch in a case where the motor 300 is rotated in the reverse direction. However, the present disclosure is not limited thereto. For example, a clutch may be provided between the motor 300 and the developing roller 12, and the clutch may he cut off by the controller 200 so that the drive is not to be input to the developing roller 12 in a case where the reverse rotation control is executed. Alternatively, the developing roller 12 may be configured to rotate in the same direction, irrespective of the rotating direction of the motor 300.

In the above illustrative embodiment, the charger 182 including the charging wire and the grid electrode has been exemplified. However, the present disclosure is not limited thereto. For example, the charger may be a circular cylinder-shaped charging roller or the like.

In the above illustrative embodiment, the contact-type developing device 1 including the developing roller 12 in contact with the photosensitive member 181 has been exemplified. However, the present disclosure is not limited thereto. For example, a contactless type developing device that is not in contact with the photosensitive member 181 may also be used.

In the above illustrative embodiment, the present disclosure has been applied to the laser printer 100. However, the present disclosure is not limited thereto. For example, the present disclosure can be applied to the other image forming apparatuses such as a copier, a complex machine and the like.

The sheet S may be a thick sheet, a postcard, a thin sheet, an OHP sheet or the like.

In the above illustrative embodiment, the scanner configured to emit the laser has been exemplified as the exposure device 150. However, the present disclosure is not limited thereto. For example, an exposure device having an LED head may also be used.

Also, the respective elements described in the above illustrative embodiment and modified embodiments may be implemented with being arbitrarily combined.

What is claimed is:

1. An image forming apparatus comprising:

a photosensitive member;

a charger configured to charge the photosensitive member;

a developing device configured to develop an electrostatic latent image on the photosensitive member;

a transfer device configured to transfer a developer image on the photosensitive member to a sheet; and a controller configured to execute:

a printing control, in which the controller rotates the photosensitive member in a forward direction and applies a first transfer bias to the transfer device;

a reverse rotation control, in which the controller rotates the photosensitive member in a reverse direction and applies a second transfer bias to the transfer device after finishing the printing control, the second transfer bias being zero or having an opposite polarity to the first transfer bias and an absolute value smaller than the first transfer bias; and a forward rotation control, in which the controller rotates the photosensitive member in the forward direction and applies a third transfer bias to the transfer device for a predetermined period of time including a time that a part of the photosensitive member reaches the transfer device after finishing the reverse rotation control, the part facing the developing device at a time of switching the rotating direction of the photosensitive member, and the third transfer bias having an opposite polarity to the first transfer bias and an absolute value larger than the second transfer bias.

2. The image forming apparatus according to claim 1, wherein the predetermined period of time is a time period within a length of time that the photosensitive member rotates one turn.

3. The image forming apparatus according to claim 1, wherein the controller is configured to increase an absolute value of the third transfer bias as a rotating speed of the photosensitive member for the predetermined time period is higher.

4. The image forming apparatus according to claim 1, further comprising:

a roller configured to convey a sheet; and a motor configured to input a drive force to the roller and the photosensitive member, wherein rotating directions of the roller and the photosensitive member are changed in correspondence to a rotating direction of the motor, and in a case where the controller changes a conveying direction of the sheet, the controller changes the rotating direction of the motor and executes the reverse rotation control.

5. The image forming apparatus according to claim 1, wherein the developing device comprises a developing roller configured to supply developer to the photosensitive member, the image forming apparatus comprises a motor configured to input a drive force to the photosensitive member and the developing roller, and the controller controls to input the drive force of the motor to the developing roller in a case where the photosensitive member rotates in the forward direction, and controls not to input the drive force of the motor to the developing roller in a case where the photosensitive member rotates in the reverse direction.

6. The image forming apparatus according to claim 1,
wherein the controller rotates the photosensitive member at a first peripheral speed in the forward direction in a case of executing the printing control, and
the controller rotates the photosensitive member at a second peripheral speed equal to or lower than the first peripheral speed in the reverse direction in a case of executing the reverse rotation control.

7. The image forming apparatus according to claim 1, further comprising an exposure device configured to expose the photosensitive member,
wherein the controller executes the printing control after finishing the forward rotation control,
the controller switches a transfer bias, that is applied to the transfer device when the predetermined period of time elapses, from the third transfer bias to the first transfer bias, and
the controller starts exposure by the exposure device after a part of the photosensitive member passes a position facing the exposure device, the part facing the transfer device at a time of switching of the transfer bias.

8. An image forming method of an image forming apparatus that includes:
a photosensitive member;
a charger configured to charge the photosensitive member;
a developing device configured to develop an electrostatic latent image on the photosensitive member; and
a transfer device configured to transfer a developer image on the photosensitive member to a sheet,
the method comprising:
a printing step of rotating the photosensitive member in a forward direction and applying a first transfer bias to the transfer device;
a reverse rotation step of rotating the photosensitive member in a reverse direction and applying a second transfer bias to the transfer device after finishing the printing step, the second transfer bias being zero or having an opposite polarity to the first transfer bias and an absolute value smaller than the first transfer bias; and
a forward rotation step of rotating the photosensitive member in the forward direction and applying a third transfer bias to the transfer device for a predetermined period of time including a time that a part of the photosensitive member reaches the transfer device after finishing the reverse rotation step, the part facing the developing device at a time of switching the rotating direction of the photosensitive member, and the third transfer bias having an opposite polarity to the first transfer bias and an absolute value larger than the second transfer bias.

9. The image forming method according to claim 8,
wherein the predetermined period of time is a time period within a length of time that the photosensitive member rotates one turn.

10. The image forming method according to claim 8, further comprising the step of:
increasing an absolute value of the third transfer bias as a rotating speed of the photosensitive member for the predetermined time period is higher.

11. The image forming method according to claim 8,
wherein the image forming apparatus further including:
a roller configured to convey a sheet and
a motor configured to input a drive force to the roller and the photosensitive member, and
the method further comprising the steps of:
changing rotating directions of the roller and the photosensitive member in correspondence to a rotating direction of the motor: and
in a case of changing a conveying direction of the sheet, changing the rotating direction of the motor and executing the reverse rotation step.

12. The image forming method according to claim 8,
wherein the developing device includes a developing roller configured to supply developer to the photosensitive member,
the image forming apparatus includes a motor configured to input a drive force to the photosensitive member and the developing roller, and the method further comprising the step of:
controlling to input the drive force of the motor to the developing roller in a case where the photosensitive member rotates in the forward direction, and controlling not to input the drive force of the motor to the developing roller in a case where the photosensitive member rotates in the reverse direction.

13. The image forming method according to claim 8, further comprising the steps of;
rotating the photosensitive member at a first peripheral speed in the forward direction in a case of executing the printing step; and
rotating the photosensitive member at a second peripheral speed equal to or lower than the first peripheral speed in the reverse direction in a case of executing the reverse rotation step.

14. The image forming method according to claim 8,
wherein the image forming apparatus includes an exposure device configured to expose the photosensitive member,
wherein the printing step is executed after finishing the forward rotation step, and
wherein the method comprising the steps of:
switching a transfer bias, that is applied to the transfer device when the predetermined period of time elapses, from the third transfer bias to the first transfer bias; and
starting exposure by the exposure device after a part of the photosensitive member passes a position facing the exposure device, the part facing the transfer device at a time of switching of the transfer bias.

* * * * *